US011098966B2

(12) United States Patent
Holmes et al.

(10) Patent No.: US 11,098,966 B2
(45) Date of Patent: Aug. 24, 2021

(54) HEADER TANK FOR HEAT EXCHANGER

(71) Applicants: DENSO International America, Inc., Southfield, MI (US); DENSO CORPORATION, Kariya (JP)

(72) Inventors: Mark Holmes, Troy, MI (US); Xiaomin Chen, Troy, MI (US)

(73) Assignees: DENSO International America, Inc., Southfield, MI (US); DENSO CORPORATION, Kariya (JP)

( * ) Notice: Subject to any disclaimer, the term of this patent is extended or adjusted under 35 U.S.C. 154(b) by 87 days.

(21) Appl. No.: 16/058,236

(22) Filed: Aug. 8, 2018

(65) Prior Publication Data

US 2020/0049430 A1 Feb. 13, 2020

(51) Int. Cl.
*F28F 9/02* (2006.01)

(52) U.S. Cl.
CPC ..... *F28F 9/0268* (2013.01)

(58) Field of Classification Search
CPC ..... F28F 9/0202; F28F 9/0207; F28F 9/0214; F28F 9/0268; F28F 2009/222; F28F 2009/224; F28F 1/126; F28F 9/0226; F28D 1/05366
See application file for complete search history.

(56) References Cited

U.S. PATENT DOCUMENTS

| | | | | |
|---|---|---|---|---|
| 3,623,913 | A | 11/1971 | Adlhart et al. | |
| 5,020,586 | A | 6/1991 | Mansingh | |
| 5,099,913 | A | 3/1992 | Kadle | |
| 6,062,303 | A | 5/2000 | Ahn et al. | |
| 6,116,335 | A | 9/2000 | Beamer et al. | |
| 6,269,541 | B1 | 8/2001 | Iguchi et al. | |
| 6,378,605 | B1 | 4/2002 | Kutscher et al. | |
| 8,925,345 | B2 | 1/2015 | Stephens et al. | |
| 2001/0003302 | A1 | 6/2001 | Azar | |
| 2002/0073718 | A1 | 6/2002 | Maisotsenko et al. | |
| 2004/0134650 | A1 * | 7/2004 | Acre | F28F 9/0214 165/297 |
| 2007/0017664 | A1 | 1/2007 | Beamer et al. | |
| 2007/0187080 | A1 * | 8/2007 | Sonoda | F28F 9/0246 165/174 |
| 2008/0156469 | A1 | 7/2008 | Lee et al. | |
| 2014/0000841 | A1 | 1/2014 | Baker et al. | |

(Continued)

FOREIGN PATENT DOCUMENTS

| | | | | |
|---|---|---|---|---|
| FR | 2910120 A1 * | 6/2008 | | F28D 1/05316 |
| JP | S57100086 U | 6/1982 | | |

(Continued)

OTHER PUBLICATIONS

English translation of FR 2910120A1 (Year: 2006).*
English translation of JP 07243790A (Year: 1995).*

*Primary Examiner* — Tho V Duong
(74) *Attorney, Agent, or Firm* — Harness, Dickey & Pierce, P.L.C.

(57) ABSTRACT

A header tank of a heat exchanger. The header tank includes a housing defining a coolant chamber through which coolant flows. The header tank further includes a flow control member, which extends into the coolant chamber. The flow control member is configured to advantageously reduce swirling of coolant in the coolant chamber, reduce velocity of coolant in the coolant chamber, and reduce liquid pressure drop of the heat exchanger.

12 Claims, 4 Drawing Sheets

(56) References Cited

U.S. PATENT DOCUMENTS

| | | | | |
|---|---|---|---|---|
| 2014/0166249 | A1* | 6/2014 | Goenka | F28D 1/05366 165/148 |
| 2015/0053384 | A1* | 2/2015 | Ishibashi | F28F 9/0268 165/173 |
| 2017/0284343 | A1 | 10/2017 | Nitta et al. | |

FOREIGN PATENT DOCUMENTS

| | | | | | |
|---|---|---|---|---|---|
| JP | S60154786 | U | | 10/1985 | |
| JP | S61-096188 | U | | 6/1986 | |
| JP | 07243790 | A | * | 9/1995 | F28F 9/0265 |
| JP | 2009092343 | A | * | 4/2009 | F28F 9/0204 |
| WO | 2008107656 | A1 | | 9/2008 | |

* cited by examiner

HEADER TANK FOR HEAT EXCHANGER

FIELD

The present disclosure relates to a header tank for a heat exchanger.

BACKGROUND

This section provides background information related to the present disclosure, which is not necessarily prior art.

Heat exchangers, such as radiators, typically include an inlet header tank through which coolant flows prior to reaching a core of the heat exchanger. While existing header tanks are suitable for their intended use, they are subject to improvement. For example, current header tank geometry occasionally causes coolant flowing through the header tank to swirl. This swirling flow causes an increase in pressure drop in the heat exchanger. The swirling coolant also causes an increase in coolant velocity in the inlet header tank, which can lead to increased erosion of tube ends inside the header tank. An improved header tank that minimizes the occurrence of coolant swirling would therefore be desirable. Such a header tank would advantageously reduce the liquid pressure drop of the heat exchanger, and reduce the risk of erosion in the tube ends inside the header tank. The present disclosure advantageously provides for an improved header tank that reduces swirling and provides numerous additional advantages as explained herein, and as one skilled in the art will appreciate.

SUMMARY

This section provides a general summary of the disclosure, and is not a comprehensive disclosure of its full scope or all of its features.

The present disclosure includes a header tank of a heat exchanger. The header tank includes a housing defining a coolant chamber through which coolant flows. The header tank further includes a flow control member, which extends into the coolant chamber. The flow control member advantageously reduces swirling of coolant in the coolant chamber, reduces velocity of coolant in the coolant chamber, and reduces liquid pressure drop of the heat exchanger.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of select embodiments and not all possible implementations, and are not intended to limit the scope of the present disclosure.

Corresponding reference numerals indicate corresponding parts throughout the several views of the drawings.

DETAILED DESCRIPTION

Example embodiments will now be described more fully with reference to the accompanying drawings.

Figure 1:
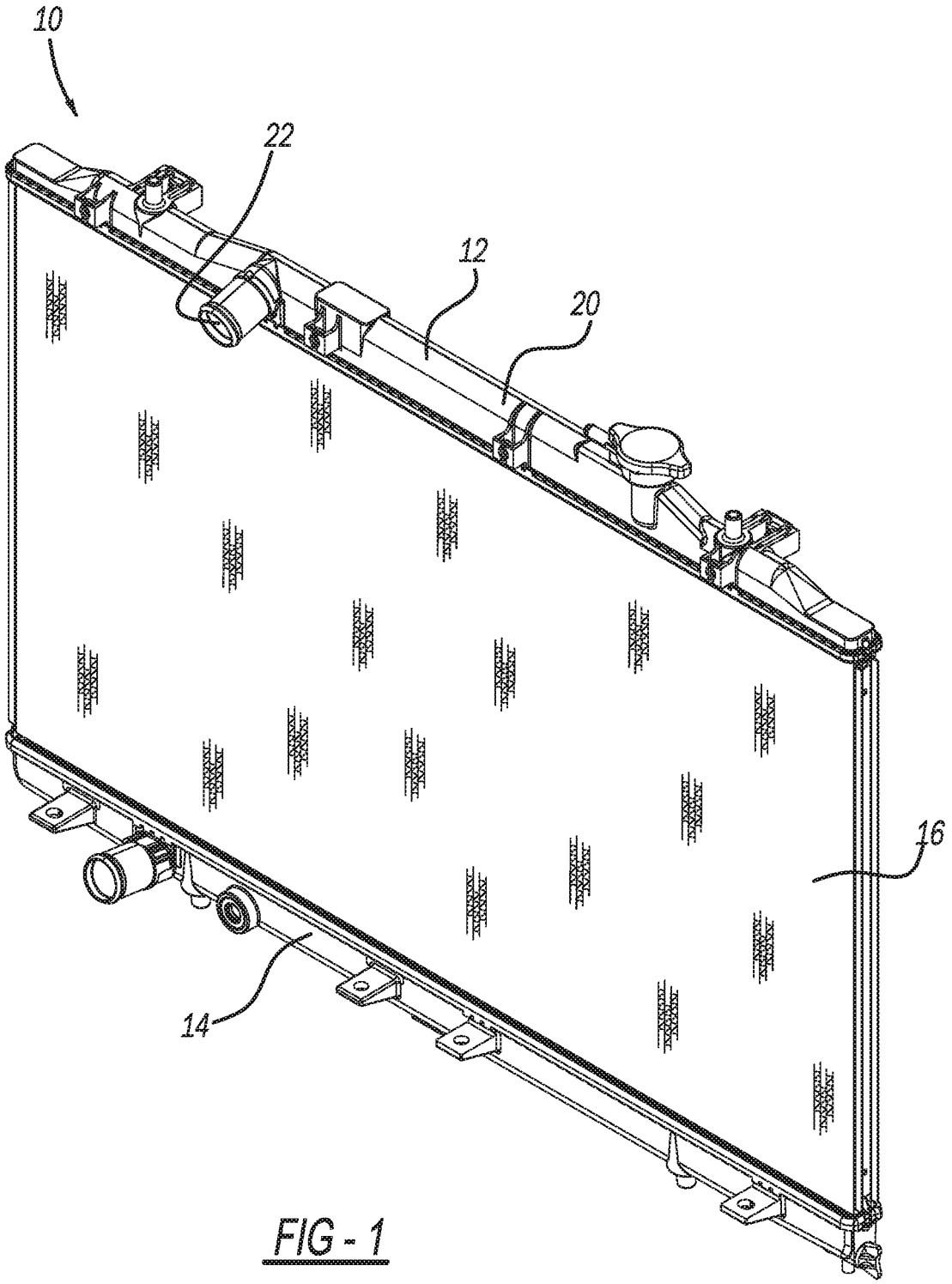
FIG. 1 is a perspective view of a heat exchanger including a header tank.

FIG. 1 illustrates an exemplary heat exchanger 10. The heat exchanger 10 may be any suitable heat exchanger, such as a radiator. The heat exchanger 10 includes an inlet header tank 12 in accordance with the present disclosure. The heat exchanger 10 further includes an outlet header tank 14 and a core 16, which is between the inlet header tank 12 and the outlet header tank 14. The inlet header tank 12 includes a housing 20, which defines an inlet 22. Any coolant suitable for the heat exchanger 10 is introduced into the inlet header tank 12 through the inlet 22. The coolant flows from the inlet header tank 12 to the core 16, and ultimately to the outlet tank 14. The coolant exits the outlet tank 14 through an outlet thereof.

Figure 2:
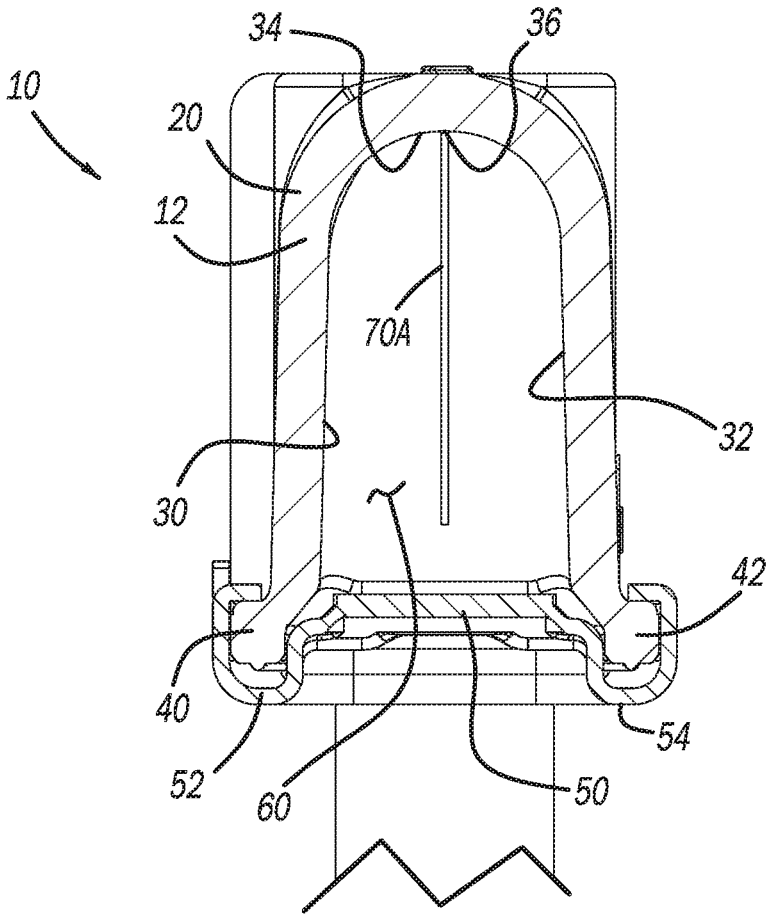
FIG. 2 is a cross-sectional view of the header tank of FIG. 1 including a flow control member in accordance with the present disclosure.

With reference to FIG. 2, the housing 20 includes a first sidewall 30 and a second sidewall 32, which extend generally parallel to one another. A ceiling or top portion 34 connects the first sidewall 30 and the second sidewall 32 together. The ceiling 34 is generally curved, and has an apex 36 at an interior surface thereof. Extending from the first sidewall 30 is a first foot 40, and extending from the second sidewall 32 is a second foot 42.

The housing 20 of the header tank 12 is coupled to a header plate 50. Specifically, the first foot 40 is seated within a first receptacle 52 defined by the header plate 50. The second foot 42 is seated in a second receptacle 54 defined by the header plate 50. The housing 20 and the header plate 50 together define a coolant chamber 60 through which coolant introduced through the inlet 22 flows.

The inlet header tank 12 further includes one or more flow control members extending into the coolant chamber 60 from one or more of the ceiling 34, the first sidewall 30, and the second sidewall 32. The flow control member is any suitable flow control member configured to reduce swirling of coolant in the coolant chamber 60, reduce velocity of coolant in the coolant chamber 60, and/or reduce liquid pressure drop of the heat exchanger 10. The flow control member may be any suitable fin or rib, for example.

In the example of FIG. 2, the flow control member is a fin 70A. The fin 70A extends from the apex 36 of the ceiling 34 into the coolant chamber 60. The fin 70A extends towards the header plate 50, and terminates prior to reaching the header plate 50. For example, the fin 70A may extend from the ceiling 34 about two-thirds of the way to the header plate 50. The fin 70A extends any suitable distance along a length of the housing 20. In many applications, the fin 70A will not extend along an entire length of the housing 20. The fin 70A may be formed integral with the housing 20, such as molded with the housing 20, or attached to the housing 20 in any suitable manner.

Figure 3:
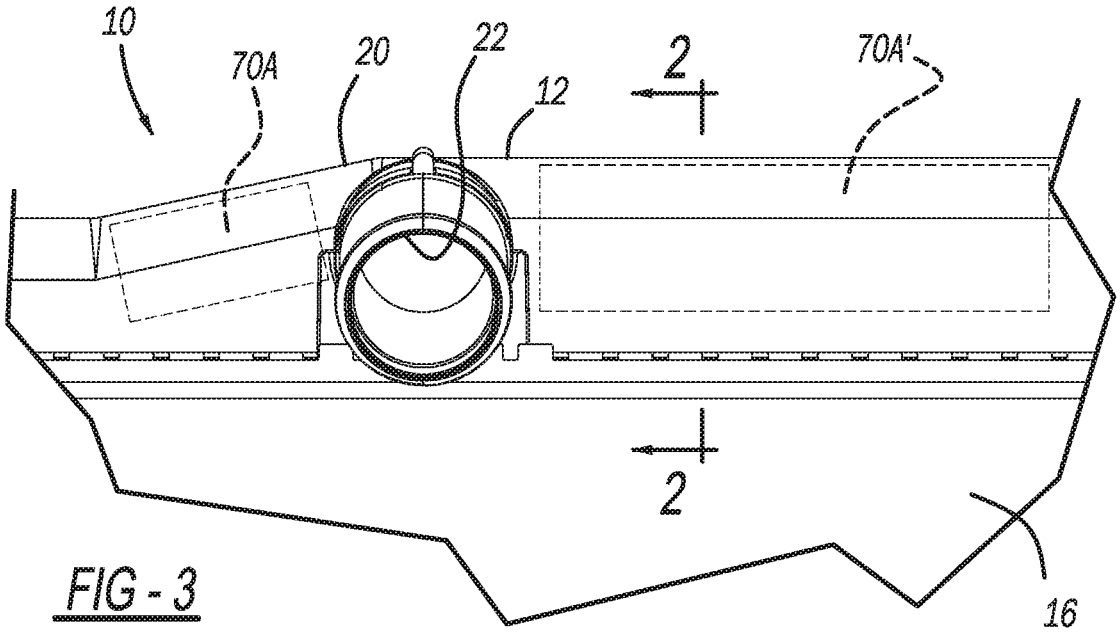
FIG. 3 is a side view of the header tank of FIG. 1 including flow control members on opposite sides of an inlet of the header tank in accordance with the present disclosure.
Figure 4:
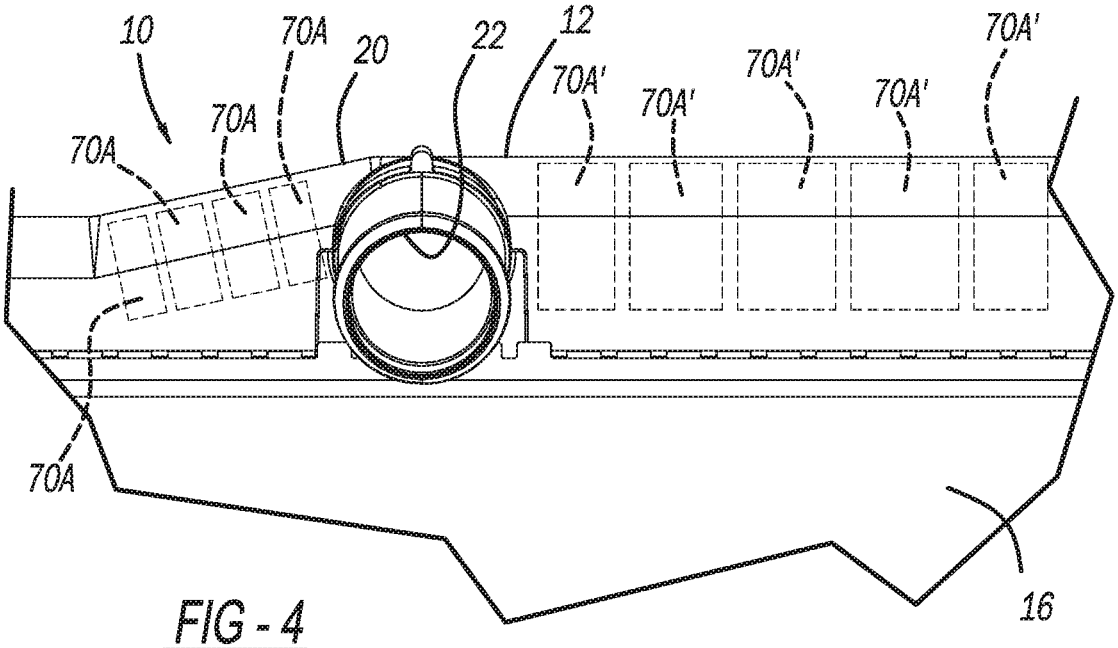
FIG. 4 is a side view of the header tank including a plurality of flow control members on both sides of the inlet of the header tank in accordance with the present disclosure.

With reference to FIG. 3, the fin may include a first portion 70A on a first side of the inlet 22, and a second portion 70A' on a second side of the inlet 22. Thus the inlet 22 is between the first portion 70A and the second portion 70A'. The present disclosure includes applications having the first portion 70A or the second portion 70A' alone, as well as applications having both the first portion 70A and second portion 70A'. With reference to FIG. 4, the fin 70A may not be continuous along the length of the housing 20. Instead, the fin 70A may include a plurality of spaced apart first portions 70A on a first side of the inlet 22, and a plurality of spaced apart second portions 70A' on a second side of the inlet 22.

Figure 5:
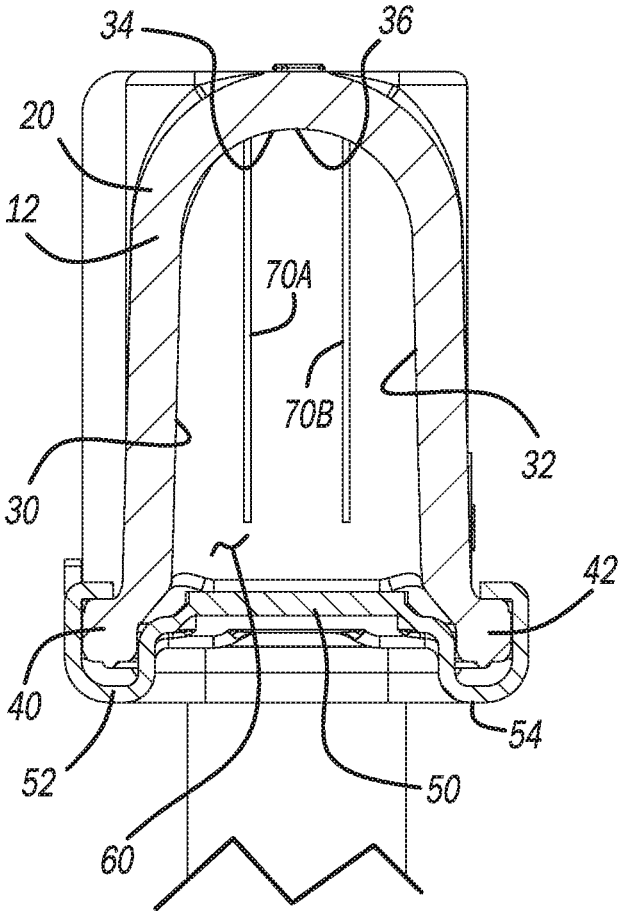
FIG. 5 is a cross-sectional view of the header tank including two flow control members extending parallel to one another in accordance with the present disclosure.

The inlet header tank 12 may include multiple flow control members. For example and as illustrated in FIG. 5, the housing 20 may include the fin 70A as a first fin, and may further include a second fin 70B. The first and second fins 70A and 70B both extend from the ceiling 34 on opposite sides of the apex 36. The first and second fins 70A and 70B extend generally parallel to one another, and parallel to a longitudinal axis of the housing 20. Similar to the arrangements of FIGS. 3 and 4 with respect to the first fin 70A, the second fin 70B may include one or more first portions on a first side of the inlet 22, and one or more second portions on a second side of the inlet 22. The first and second fins 70A and 70B may both be formed integral with the housing 20, or attached to the housing 20 in any suitable manner.

Figure 6:
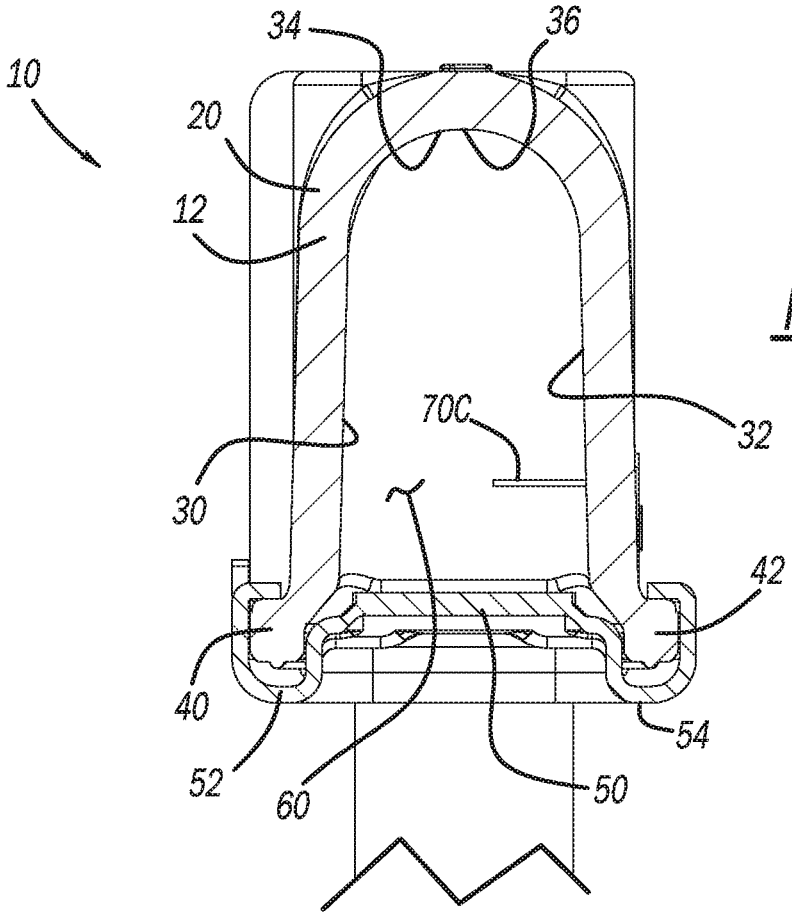
FIG. 6 is a cross-sectional view of the header tank including a flow control member extending into a coolant chamber from a sidewall of the header tank in accordance with the present disclosure.

With additional reference to FIG. 6, the flow control member may be a fin 70C extending from the first sidewall 30 or the second sidewall 32 as illustrated. Like the fin 70A, the fin 70C may include a first portion and a second portion on opposite sides of the inlet 22. The first and second portions of the fin 70C on opposite sides of the inlet 22 may each be unitary (similar to the first and second portions 70A and 70A' illustrated in FIG. 3) or configured as a plurality of spaced apart portions on opposite sides of the inlet 22 (similar to the plurality of first portions 70A and the plurality of second portions 70A' illustrated in FIG. 4). The fin 70C extends perpendicular to the second sidewall 32 into the coolant chamber 60. The fin 70C may extend any suitable distance into the coolant chamber 60, and terminates prior to reaching the first sidewall 30. The fin 70C is secured to the first or second sidewalls 30, 32 in any suitable manner. For example, the fin 70C may be formed integral with the first or second sidewalls 30, 32, such as by molding, or attached thereto in any suitable manner. The housing 20 may include only a single fin 70C as illustrated in FIG. 6, or multiple fins on the second sidewall 32, multiple fins on the first sidewall 30, or one or more fins on each one of the first and second sidewalls 30, 32.

The present disclosure thus advantageously provides for an inlet header tank 12 including flow control members (such as one or more fins 70A, 70A', 70B, 70C), which reduce the amount of coolant swirling within the coolant chamber 60. Specifically, testing shows that the flow control members (such as one or more fins 70A, 70A', 70B, 70C) resulted in at least a 5% reduction in pressure drop of the heat exchanger 10. The flow control members 70A, 70A', 70B, 70C also reduce velocity of coolant in the coolant chamber 60, which reduces the risk of erosion at tube ends inside the header tank 12. Furthermore, the reduction in pressure provides numerous efficiencies. For example, a smaller coolant pump requiring less energy may be used to pump coolant through the heat exchanger 10 due to a reduction in coolant flow resistance. The present disclosure also advantageously improves thermal cycle performance because the flow control members (such as one or more fins 70A, 70A', 70B, 70C) reduce swirling of coolant in the coolant chamber 60. As a result, more coolant flow can reach the end of the tank 12, thus reducing the temperature gradient, thereby improving thermal cycle performance.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

Example embodiments are provided so that this disclosure will be thorough, and will fully convey the scope to those who are skilled in the art. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms and that neither should be construed to limit the scope of the disclosure. In some example embodiments, well-known processes, well-known device structures, and well-known technologies are not described in detail.

The terminology used herein is for the purpose of describing particular example embodiments only and is not intended to be limiting. As used herein, the singular forms "a," "an," and "the" may be intended to include the plural forms as well, unless the context clearly indicates otherwise. The terms "comprises," "comprising," "including," and "having," are inclusive and therefore specify the presence of stated features, integers, steps, operations, elements, and/or components, but do not preclude the presence or addition of one or more other features, integers, steps, operations, elements, components, and/or groups thereof. The method steps, processes, and operations described herein are not to be construed as necessarily requiring their performance in the particular order discussed or illustrated, unless specifically identified as an order of performance. It is also to be understood that additional or alternative steps may be employed.

When an element or layer is referred to as being "on," "engaged to," "connected to," or "coupled to" another element or layer, it may be directly on, engaged, connected or coupled to the other element or layer, or intervening elements or layers may be present. In contrast, when an element is referred to as being "directly on," "directly engaged to," "directly connected to," or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

Although the terms first, second, third, etc. may be used herein to describe various elements, components, regions, layers and/or sections, these elements, components, regions, layers and/or sections should not be limited by these terms. These terms may be only used to distinguish one element, component, region, layer or section from another region, layer or section. Terms such as "first," "second," and other numerical terms when used herein do not imply a sequence or order unless clearly indicated by the context. Thus, a first element, component, region, layer or section discussed below could be termed a second element, component, region, layer or section without departing from the teachings of the example embodiments.

Spatially relative terms, such as "inner," "outer," "beneath," "below," "lower," "above," "upper," and the like, may be used herein for ease of description to describe one element or feature's relationship to another element(s) or feature(s) as illustrated in the figures. Spatially relative terms may be intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly.

What is claimed is:

1. A header tank of a heat exchanger, the header tank comprising:

a housing including a first sidewall having a first foot secured within a first receptacle of a header plate, a second sidewall having a second foot secured within a second receptacle of the header plate, and a ceiling connecting the first sidewall to the second sidewall;

a coolant chamber for coolant flow therethrough, the coolant chamber defined by the first sidewall, the second sidewall, the ceiling, and the header plate; and a plurality of flow control fins extending into the coolant chamber from an apex of the ceiling towards the header plate, the plurality of flow control fins are aligned along, and spaced apart along, a longitudinal axis extending along a length of the header such that the plurality of flow control fins extend parallel to the first sidewall and the second sidewall, the plurality of flow control fins configured to reduce swirling of coolant in the coolant chamber, reduce velocity of coolant in the coolant chamber, and reduce liquid pressure drop of the heat exchanger.

2. The header tank of claim 1, wherein the header tank is a radiator header tank.

3. The header tank of claim 1, wherein the plurality of flow control fins include a first fin portion on a first side of an inlet port of the housing and a second fin portion on a second side of the inlet port.

4. The header tank of claim 1, wherein the plurality of flow control fins include a plurality of first spaced apart fin portions on a first side of an inlet port of the housing and a plurality of second spaced apart fin portions on a second side of the inlet port.

5. The header tank of claim 1, wherein the plurality of flow control fins include a first flow control fin extending parallel to a second flow control fin.

6. A header tank of a heat exchanger, the header tank comprising:

a housing including a first sidewall having a first foot secured within a first receptacle of a header plate, a second sidewall having a second foot secured within a second receptacle of the header plate, and a ceiling connecting the first sidewall and the second sidewall together;

a coolant chamber for coolant flow therethrough, the coolant chamber defined by the first sidewall, the second sidewall, the ceiling, and the header plate; and a plurality of flow control fins extending into the coolant chamber from an apex of the ceiling towards the header plate, the plurality of flow control fins are aligned along, and spaced apart along, a longitudinal axis extending along a length of the header tank such that the plurality of flow control fins extend along the length of the coolant chamber parallel to the first sidewall and the second sidewall;

wherein the plurality of flow control fins reduce swirling of coolant in the coolant chamber, reduce velocity of coolant in the coolant chamber, and reduce liquid pressure drop of the heat exchanger.

7. The header tank of claim 6, wherein the plurality of flow control fins extend towards the header plate of the heat exchanger.

8. The header tank of claim 7, wherein the plurality of flow control fins terminate prior to reaching the header plate.

9. The header tank of claim 6, wherein the plurality of flow control fins include a first flow control fin portion on a first side of an inlet defined by the header tank, and a second flow control fin portion on a second side of the inlet.

10. The header tank of claim 6, wherein the plurality of flow control fins include a plurality of first flow control fin portions on a first side of an inlet defined by the header tank, and a plurality of second flow control fin portions on a second side of the inlet.

11. The header tank of claim 6, wherein the plurality of flow control fins include two flow control fins extending from the ceiling and extending parallel to one another along the length of the header tank.

12. The header tank of claim 6, wherein the plurality of flow control fins extend along less than an entirety of a length of the coolant chamber.

* * * * *